United States Patent [19]

Courtoy et al.

[11] Patent Number: 4,764,411

[45] Date of Patent: Aug. 16, 1988

[54] PROCESS FOR THE PRODUCTION OF COVERINGS EXHIBITING A CRACKED APPEARANCE AND THE PRODUCT OBTAINED THEREFROM

[76] Inventors: Jean-Francois Courtoy, 49 Rue des Charretiers, Wiltz; Daniel Marchal, 17 rue Jean melsen, 9142 Burden, both of Luxembourg; Rene DuForest, 11 rue de Bois Joli, 08000 Montcy Notre Dame, France; Albert Roussel, 45 rue des Charretiers, Wiltz, Luxembourg

[21] Appl. No.: 887,271

[22] Filed: Jul. 21, 1986

[30] Foreign Application Priority Data

Jul. 22, 1985 [LU] Luxembourg ..... 86014
Sep. 23, 1985 [LU] Luxembourg ..... 86088

[51] Int. Cl.[4] ..... B05D 3/02; B05D 5/00

[52] U.S. Cl. ..... 428/155; 427/385.5; 427/257

[58] Field of Search ..... 427/257, 385.5; 428/155

[56] References Cited

U.S. PATENT DOCUMENTS 2,612,456 9/1952 Thacker et al. ..... 427/257
2,866,720 12/1958 Martin et al. ..... 427/257 X
4,247,587 1/1981 Cherault ..... 427/257 X

FOREIGN PATENT DOCUMENTS 530658 12/1921 France .
2247494 5/1975 France .
0040376 3/1983 Japan ..... 427/257

*Primary Examiner*—Michael R. Lusignan
*Attorney, Agent, or Firm*—Fishman, Dionne & Cantor

[57] ABSTRACT

A process for the production of synthetic coverings for floors, walls, etc. which exhibit a cracked effect is presented. The process includes the step of depositing on a compatible substrate, a plastisol coating composition containing a gel previously prepared from a mixture of two materials, the mixture being comprised of (1) a solid sorbent agent and (2) a solvent which causes swelling by absorption of the solvent in and on the sorbent agent; or alternately, by an aqueous dispersion of a (1) dry mixture of PVC and of (2) a plasticizer containing at least one resin forming a gel in water. Subsequent to depositing this plastisol coating on the substrate, a thermal treatment for the formation of a film or for drying is carried out at a sufficient temperature whereby an irreversible process of preliminary gelling of the coating and shrinkage of the gel by desorption of the solvent from the sorbent agent or by evaporation of the water, respectively, simultaneously occurs. Thereafter, conventional finishing operations may be carried out on the synthetic coverings.

36 Claims, 3 Drawing Sheets

PROCESS FOR THE PRODUCTION OF COVERINGS EXHIBITING A CRACKED APPEARANCE AND THE PRODUCT OBTAINED THEREFROM

BACKGROUND OF THE INVENTION

This invention relates to a process for the production of synthetic surface coverings. More particularly, this invention relates to a method of making synthetic coverings for floors, walls, etc. which exhibit a cracked appearance. This invention also relates to the products obtained in accordance with this novel process.

Increasingly, in the production of synthetic decorative coverings intended for floors, walls, and the like, attempts have been made to manufacture the coverings using conventional and naturally occurring materials such as ceramics and the like. A particularly decorative effect obtained when using ceramic materials resides in the naturally occuring cracks. However, such a cracked appearance is difficult to obtain with synthetic materials deposited in the form of a coating, for example, on a conventional substrate. Moreover, the attempted reproduction of cracks by printing leads to the problem of precluding an authentic reproduction of the "natural' cracked effect, and the motifs obtained are necessarily repetitive, i.e., without a random nature. Also, printing does not permit depth (relief) to be imparted to the synthetic covering material.

French Specification No. A2,126,658 discloses a known process for applying a covering material in the form of an emulsion in order to produce crazed (cracked) configurations. In this case, a lower synthetic covering material containing a mineral material having a high swelling property is deposited on a substrate. This lower covering material is dried, and a hardened covering material containing a silicon dioxide base is then applied thereon. In the process described in the French specification, the lower covering material absorbs the water contained in the hardened covering material and simultaneously causes both the contraction of the hardened material and the formation of crazed configurations. A disadvantage of this French process resides in the fact that there are two different layers of composition to be applied, which necesitates intermediate drying. This process is therefore time consuming and burdensome.

French Patent document No. A2,247,494 relates to a cracked film of a PVC polymer including at least one plasticizer homogenously distributed therein. French Pat. No. A2,247,494 also discloses a synthetic covering comprised of a conventional substrate covered with the PVC, a polymeric film, as well as a process for the preparation of the latter. This process relies on a two-phase system consisting of (1) polymer-plasticizer and (2) water. However, this process does not permit adequate control of the formation of the cracks or of the size of the cracks. Moreover, this process requires large quantities of water.

U.S. Pat. No. 2,612,456 similarly relates to a process for the production of a decorative and protective covering which exhibits a cracked appearance. This process utilizes an organosol including particles of an organic copolymer of vinyl chloride and vinyl acetate, said particles being dispersed in a volatile organic liquid. The organic liquid must have a swelling effect on particles of polymer. As in the above-discussed process, this process is also difficult to control making it quite difficult to obtain a dense network of cracks. Moreover, this process like-wise requires large quantities of solvent.

Accordingly, an object of the present invention is to provide a process for the production of synthetic coverings (i.e. for floors or walls), which exhibit a cracked appearance and which requires only a single layer of synthetic material to obtain the cracked effect.

Another object of the present invention is to provide a process for the production of synthetic coverings having a cracked appearance in which the required quantities of solvent or of water are substantially reduced as compared with the prior art.

Another object of the present invention is to provide a process for the production of synthetic coverings including cracks with depth, that is, relief being provided substantially throughout the mass of at least one layer of the covering.

Yet another object of the present invention is to provide a synthetic covering for floors, walls and the like which exhibit a cracked appearance having a random nature.

SUMMARY OF THE INVENTION

In accordance with the present invention, a process for the production of synthetic coverings for floors, walls, etc. which exhibit a cracked appearance comprises the steps of depositing on a compatable substrate a coating composition of a plastisol containing a gel previously prepared from a mixture of two materials, the mixture being comprised of a solid sorbent agent; and by a solvent which causes the swelling by absorption of the solvent in and on the sorbent agent; or alternatively by a dispersion in water of a dry mixture of PVC and plasticizer containing at least one resin forming a gel in the water. A thermal treatment is then preformed for the formation of a film or for drying at a sufficient temperature so that there takes place concomitantly an irreversible process of preliminary gelling of the coating and the shrinkage of the gel by desorption of the solvent from the sorbent agent or by evaporation of the water, respectively. Therafter, conventional and known finishing operations may be carried out.

The process of the present invention permits the achievement of the above enumerated objects of the invention, and in particular, permits the production of a covering exhibiting a cracked effect, in which the cracks extend in a random manner, with depth, within the mass of the synthetic covering.

BRIEF DESCRIPTION OF THE DRAWING

Referring now to the drawings.

DESCRIPTION OF THE PREFERRED EMBODIMENT

Figure 1:
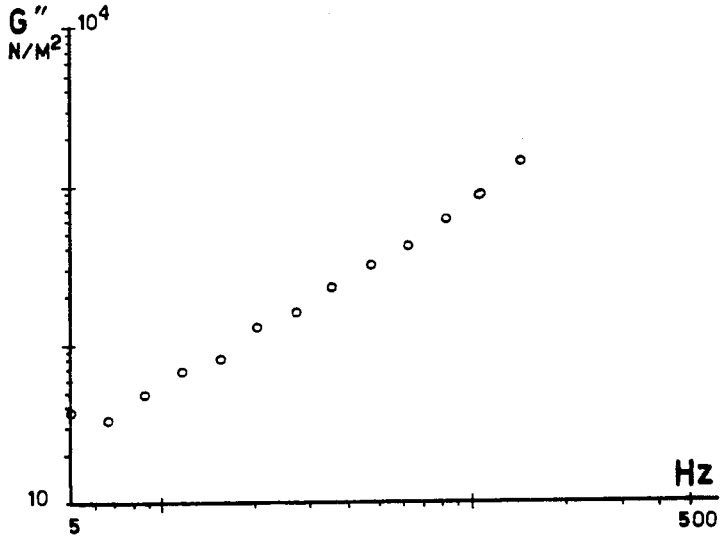
FIGS. 1–3 are graphical representations plotting frequencies (in Hz) versus Modules G″ or dissipation modulus (in $N/M^2$)

An important feature of the present invention is the selection of the sorbent agent/solvent mixture which is utilized under the particular conditions of the process of the invention. Preferably, the solvent should not interfere with the plasticizing effect of the other additives of the synthetic material used for the production of the covering. Use preferably is made of a solvent which does not participate in the plasticizing process, although the use of a solvent which does participate in plasticizing may also be contemplated. In accordance with a particularly preferred embodiment of the present invention, the absorbent agent is a silica or a silicate, preferably having a specific surface according to BET in the range of between 250 and 700 $m^2/g$, preferably on the order of 300 to 400 $m^2/g$. The coating composition advantageously includes about 0.5% by weight of sorbent agent.

Preferably, use is made of a solvent having a vapor pressure which is very high at the temperature of formation of the synthetic film, so that the sorbent agent is withdrawn by desorption of the solvent as soon as the film forms during the thermal treatment (with a view to "tearing" it by forming cracks). It should be understood that the temperature at which the solvent has a high vapor pressure, or the boiling point of the solvent, must be close to the temperature of formation of the film, since, if this temperature is too high, there will be no formation of cracks, by reasons of both (1) fusion and (2) of the surface tension of the snythetic coating. On the other hand, if this temperature is too low, there will be evaporation prior to formation of the film. It is important to ensure that the force of the retraction is greater than the force of cohesion of the film. Accordingly, the solvent should be one in which the hydrocarbon fractions, and in particular white spirits, are at a level on the order of about 15 to about 35% by weight of the plastisol coating.

The following products may also be suitable as solvents (It will be appreciated that the following list is by way of example only, and is not limiting in any manner):

(1) solvents of the SHELLSOL ® TD or AB type;
(2) hydrocarbon fractions other than white spirit, having suitable evaporation/retention properties;
(3) solvents of the POLYSOLVAN ® type, i.e. N-butyl esters of glycol; and
(4) solvents of the DOWANOL DPN ® type, i.e. the methyl ether of dipropylene glycol.

Previously, the temperature of formation of the plastisol coating film is selected from between about 110 and about 160° C. It is possible to subsequently subject the coating to, for example, a temperature on the order of 200° C. for 1 minute to 2 minutes 30 seconds, if it is desired to modify the initial opening of the cracks without any effect on the number of cracks.

In the alternative enbodiment of the present invention wherein the substrate is applied with a coating of a dispersion in water of a dry mixture of PVC and plasticizer, it will be appreciated that the resin forming a gel in the presence of water may be selected from a wide range of products which are commercially available. For reasons of compatibility with the medium employed and the substrate on which it is coated, preference is given to mixtures based on cellulose resins having a thickening action.

The addition of a solvating agent such as ethyl glycol to the water is particularly useful in order to bring about swelling of the resin forming a gel.

The additives which are required for the stabilization of the aqueous dispersion are well known in the art, and a large quantity of commercial products are available.

Preferably, not only sufractants will be added to the preparation for stabilization purposes; but also antifoam agents will be added to facilitate the preparation of the dispersion and to produce a regular coating.

The preparation of the dispersion, advantageously includes the presence of fillers (which may or may not be pigmenting). These fillers particularly effect the size of the cracks or crazed formations which are observed.

Advantageously, the temperature of the thermal drying treatment is selected to be from about 180 to about 210° C. Subsequently, the coating may be subjected (by example only) to a temperature on the order of 200° C. for 1 minute to 2 minutes 30 seconds, if it is desired to modify the initial opening of the cracks without having any effect on the number therof.

As already discussed, in accordance with the present invention, a coating composition of plastisol containing the sorbent agent/solvent mixture; or the aqueous dispersion of a dry mixture of PVC and of a plasticizer containing a resin forming a gel in water is applied to a substrate. In one embodiment of the present invention, the substrate may consist of a conventional substrate material which may already include one or more deposits of synthetic material. It will be appreciated that the deposits may be provided with an imprint.

In an effort to obtain particular decorative effects, in accordance with the present invention, the coating composition of plastisol of PVC containing the sorbent agent/solvent pair or the aqueous dispersion of PVC and a resin may be applied to form a gel locally, such that only a part of the decorative motif will exhibit a "cracked" appearance. This discontinuous application may be undertaken by well known techniques, for example, by a serigrpahic technique. In this way, it becomes possible to imitate particular floor or wall coverings, comprising tiles exhibiting a cracked effect and comprising joints having the appearance of cement joints which are not cracked.

In a preferred embodiment of the present invention, after the cracks have been formed, a plastisol coating may be scraped, for example, onto the covering obtained, in such a manner as to fill in the cracks with a suitable material. In one particularly preferred embodiment, it is possible to scrape either a plastisol containing up to 30% carbon black onto the product obtained or an aqueous emulsion of plasticized PVC and conductive carbon black, in such a manner as to fill in the cracks with a material which conducts electric current. Such a covering is particularly suitable for avoiding the accumulation of static electricity for coverings intended for operating theatres, computer rooms, etc. The use of a composition containing carbon black leads to a value on the order of $10^8$ ohm.cm for the transverse electrical resistance of the covering obtained (which is normally $10^{14}$ ohm.cm).

It is similarly advantageous, depending upon the effects sought, to provide an imprint or any other traditional operation on the cracked product. Also, a conventional foamable paste which, in the course of the thermal treatment, undergoes swelling so as to create an emergent veining at the surface, having the appearance of a roughcast wall may be coated into the cracks.

Finally, a coating of a conventional wear surface layer may be deposited on the synthetic covering which further improves the life of the covering obtained in accordance with the various above mentioned embodiments of the present invention.

The form, the depth and the opening of the cracks may be controlled by the temperature of the thermal treatment, by the selection of the sorbent agent/solvent pair and/or of the resin forming a gel in water, and by the quantity of solvent used. However, it should be noted that the depth and the opening of the cracks may be modified subsequently to a large extent by the thermal treatment, unless prior coating of the surface has taken place.

The several conventional operations which may be carried out on the cracked product obtained in accordance with the present invention do not need to be described in great detail in the present specification. Such known and conventional steps include, by way of example, the deposit of additional coatings, which may or may not be pigmented, imprints, deposits of a wear layer, convention thermal treatments and the final firing.

The present invention will now be described in greater detail with reference to the examples in which follow and in which all the proportions are expressed by weight, except where otherwise indicated:

EXAMPLE 1

A gel is prepared in advance, having the following composition:

100 parts of butyl-glycol acetate
10 parts of pyrogenic silica (300 $m^2/g$)- Aerosil ® 300

A plastisol composition referred to as "compact" is also prepared, containing:

650 parts of PVC in emulsion (for example: K value 72)
100 parts of PVC in suspension (for example: K value 66)
540 parts of phthalate plasticizer
500 parts of carbonate-containing fillers (calcium carbonate)
25 parts of titanium oxide
2 parts of tin-based stabilizer.

The "compact" composition and the gel which have previously been prepared are then mixed as follows:

70 parts of "compact"
35 parts of gel
10 parts of TXIB
(texanol isobutyrate - secondary plasticizer)
3.5 parts of barium-based and zinc-based stabilizer.

The content of Aerosil $300^R$ and of solvent are 2.68% and 26.31% respectively in the plastisol coating. The coating thus obtained is applied to a traditional substrate which may already have received at least one coating and/or one imprint.

The product thus obtained is subjected to a thermal treatment in such a manner as to create the cracks. This thermal treatment preferably consists of a step having a duration of 2 minutes 30 seconds, at a temperature within the range between 110° and 120° C., which is obtained by heating, for example, by means of a pulsating air oven or by infared radiation or a combination of the two.

The product obtained may then be subjected to an imprint of a decoration in accordance with known process.

It is also possible to subject the product to a second thermal treatment which permits opening of the cracks which have already been formed. Such a thermal treatment consists of a step, having a duration of 1 minute to 2 minutes 30 seconds, at a temperature on the order of 200° C.

The product is then passed under a rubber scraper, which introduces a fluid pigmented plastisol into the cracks which then undergoes preliminary jelling.

Surprisingly it has been found that, after coating by a plastisol, the cracks no longer open in the course of this preliminary jelling.

The whole assembly is then covered with a plastisol coating of PVC serving as a wear layer, and the product obtained is subjected to a jelling operation, for a period of 2 minutes 30 seconds, at a temperature of about 190° C.

It is also possible to use a poyurethane varnish crosslinkable by any appropriate means, for example UV or by an electron beam.

EXAMPLE 2 plastisol + gel

A gel is prepared, having the following composition:

80 parts of white spirit
35 parts of barium silicate such as Dutch Boy BAROSIL ® (product of National Lead, Inc. USA).

A "compact" composition, similar to that of Example 1 is also prepared, and the previously prepared gel is incorporated therein at the rate of:

50 parts of "compact" composition,
35 parts of gel,

The content of BAROSIL ® and of white spirit in the coating is 12.5% and 28.7%, respectively.

The coating obtained in this manner is deposited on a conventional substrate, which is then subjected to a thermal treatment in such a manner as to create the cracks. The thermal treatment consists of a step, having a duration of 2 minutes at 110°–120°, in, for example, an oven. The product thus obtained is then passed below a scraper in such a manner as to urge a PVC paste containing 30% of carbon black into the cracks. A thermal treatment or final firing is then carried out. The resulting product is a covering referred to as "homogeneous", the transverse electrical surface resistance of which is reduced to a value on the order of $10^8$ ohm.cm. (while it is $10^{14}$ ohm.cm for PVC) and which thus permits dispersal of the local electric charges. Such a covering could be used in a medium exhibiting high sensitivity to local charges, such as computer rooms.

EXAMPLE 3 plastisol + gel

A gel is prepared in advance, having the following composition:

10 parts by weight of AEROSIL ® 300.
100 parts by weight of white spirit.

A "compact" plastisol composition is prepared in accordance with Example 1.

The following are then mixed:

70 parts of "compact"
37 parts of gel
10 parts of TXIB.

The procedure is then carried out as in Example 1.

EXAMPLE 4

The procedure is carried out as in Example 1 or 2, but a foamable paste having the following composition is coated into the cracks obtained;

30 parts of PVC suspension of value K=66
70 parts of PVC emulsion of value K=70
32 parts of phthalate plasticizer
20 parts of TIXB
25 parts of fillers (calcium carbonate)
2 parts of $TiO_2$
2 parts of self-dispersing swelling agent.

EXAMPLE 5

(comparative example)

Figure 2:
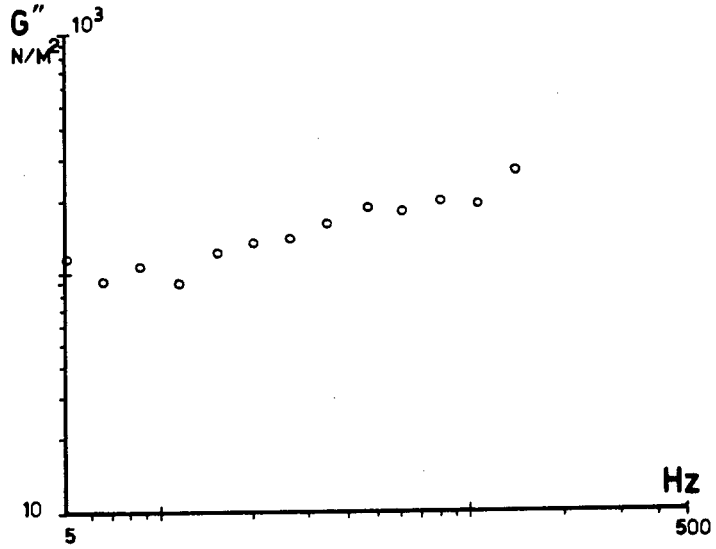
Figure 3:
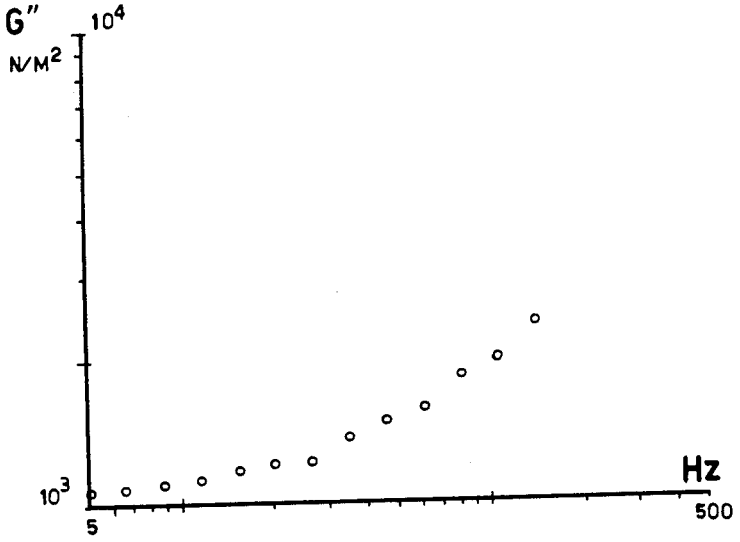
Figure 4:
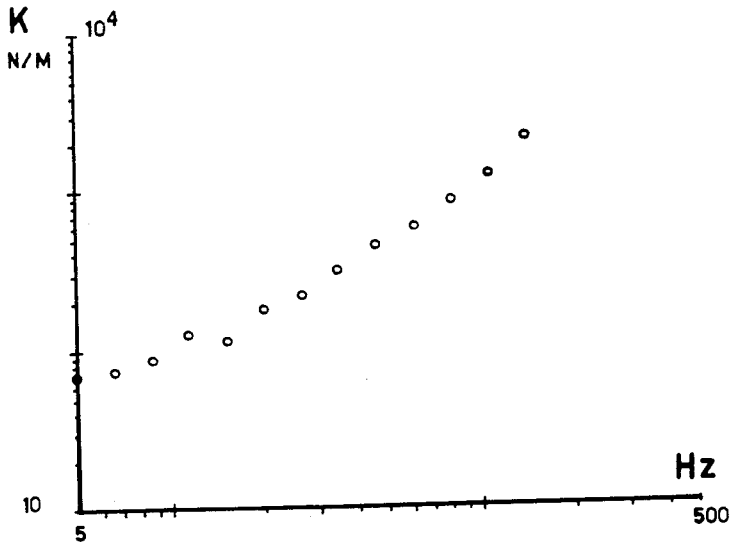
FIGS. 4–6 are graphical representations plotting frequencies (in Hz) versus Modulus K or rigidity modulus (in N/M).
Figure 5:
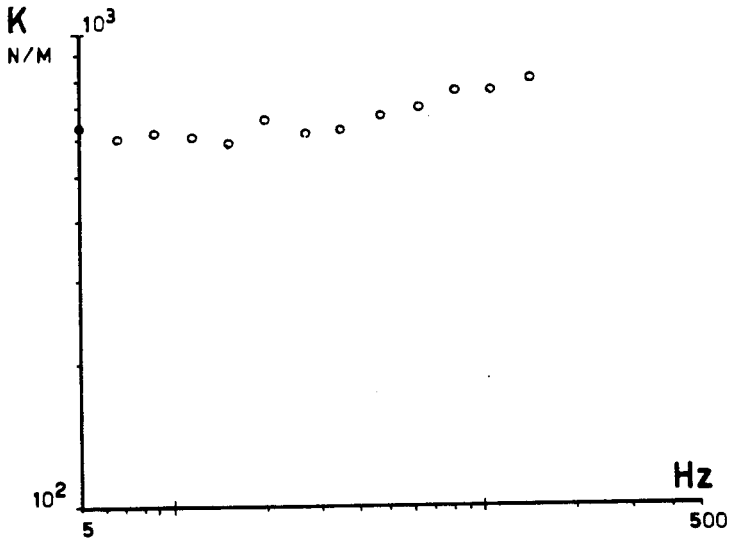
Figure 6:
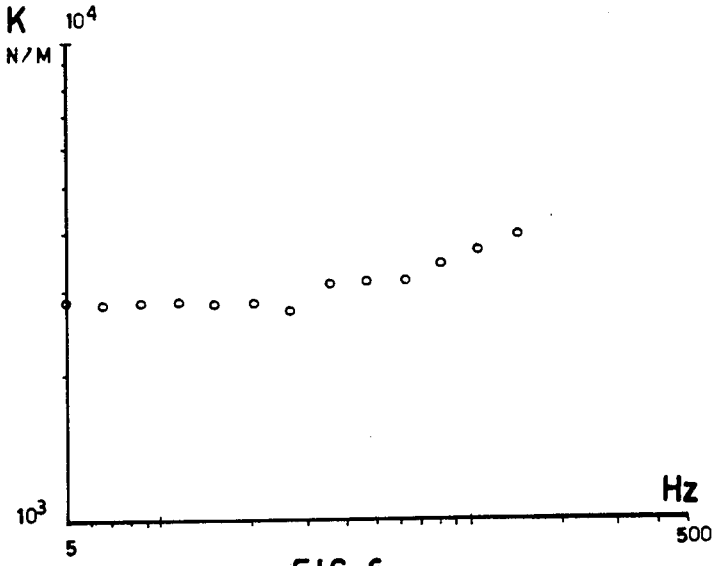

The graphs in FIGS. 1–6 show the results of laboratory tests in accordance with an annular pumping technique. FIGS. 1 to 3 show, as abscissa, the frequencies (in Hz) and, as ordinate, the modulus G" or dissipation modulus (in $N/m^2$). FIGS. 4–6 show, as abscissa, the frequencies (in Hz) and, as ordinate, the modulus K or rigidity modulus (in N/m).

FIGS. 1 and 4 relate to a "compact" composition in accordance with Example 1.

FIGS. 2 and 5 relate to the following composition:

| | |
|---|---|
| Compact according to Example 1 | 1,400 |
| Aerosil ® | 63 |
| White spirit | 637 |
| TXIB | 200 |

FIGS. 3 and 6 relate to a composition as mentioned below, in which the gel has been prepared in advance.

| | |
|---|---|
| Compact according to Example 1 | 1,400 |
| Gel | 700 |
| TXIB | 200 |

The gel comprises 63 parts of Aerosil ®300 and 637 parts of white spirit.

As the modulus G" (FIGS. 1 to 3) is proportional to the viscosity, and the frequency is proportional to the velocity gradient, annular pumping permits expression of the viscosity as a function of the velocity gradient.

It can be seen from the figures that the composition of FIG. 3 exhibits the highest level of viscosity; although for a composition having the same total contents but in which the silica and the white spirit have not been added in the form of a gel, the viscosity level is very low.

It can be concluded from this that, in the case of FIG. 2, the white spirit is not preferentially adsorbed by the silica, but is equally distributed within the medium and thus has a vicosity-lowering effect on the plastisol. In the case of FIG. 3, on the other hand, the solvent has caused the inert filler to swell and has remained there even after mixing in the final medium. It was not used to reduce the general viscosity of the plastisol. It is only the thermal treatment which will permit desorption of the solvent from the silica, causing shrinkage of the latter.

FIGS. 4 to 6 concerning the rigidity (modulus K) likewise confirm this behavior, for the same compositions.

EXAMPLE 6

Aqueous dispersion

In a rapid mixer (Papenmeier type), a dry mixture of PVC having the following composition is prepared:

| | |
|---|---|
| PVC "suspension" K value | 100 |
| Plasticizer | 35 |
| Sn stabilizer | 2 |
| Epoxidized soya oil | 3 |

When the mixture reaches the temperature of 80°–90° C., it is transferred to the refrigeration cell. In order to obtain a mixture having improved flow properties, between 3 and 5 parts of PVC "emulsion" are added thereto in the course of cooling.

An aqueous suspension prepared in a mixer (Moltini type) has the following composition:

| | |
|---|---|
| Water | 100 |
| Ethyl-glycol | 100 |
| $TiO_2$ | 5 |
| Dolomite | 150 |
| Dry PVC mixture | 200 |
| Cellulose thickener (5% aq.) | 5 |
| Surfactant | 2 |

This aqueous suspension is deposited by means of a scraper on a substrate composed of a sheet of glass coated with PVC plastisol jelled on a drum and which has the following formulation:

| | |
|---|---|
| PVC "emulsion" | 100 |
| Chalk | 50–100 |
| $TiO_2$ | 3–20 |
| Plasticizer | 50–80 |
| Sn stabilizer | 2 |
| Epoxidized soya oil | 3 |

This coating is dried and baked in a hot-air oven between 180°0 and 210° C. In the course of firing, a close and continuous network of crack appears.

EXAMPLE 7

Aqueous dispersion

Starting from the dry PVC mixture of the same formulation as in Example 1, an aqueous suspension having the following formulation is prepared:

| | |
|---|---|
| water | 80 |
| Cellulose thickener (5% aq.) | 20 |
| Dry PVC mixture | 100 |
| Dolomite | 20 |
| $TiO_2$ | 4 |

This suspension is scraped onto a subestrate identical to that in Example 1, dried and fired in a hot-air oven under the same conditions. In the course of firing, a discontinuous and sparse network of fine cracks develops.

Each type of product may be treated subsequently in various ways in order to provide finishing, for example by:

(1) printing followed by varnishing;

(2) coating with a colored varnish, which may or may not be translucent; or (3) coating with a conductive material.

Furthermore, the various aqueous suspensions may be colored in the mass by addition of a suitable pigment to their formulation.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A process for the production of surface coverings exhibiting a cracked appearance including the steps of:

depositing a plastisol coating composition on a substrate, said coating composition containing a gel prepared from a mixture, the mixture being comprised of effective amounts of a solid sorbent agent and a solvent which causes swelling by absorption of said solvent in and on the sorbent agent; and thermally treating said deposited coating, said thermal treatment being carried out at a sufficient temperature whereby an irreversible process of preliminary gelling of the coating and shrinkage of the gel by desorption of the solvent from the sorbent agent simultaneously occurs.

2. The process according to claim 1 wherein:

said substrate includes at least one deposit of synthetic material thereon prior to deposition of said plastisol coating.

3. The process according to claim 1 including:

depositing said plastisol coating composition containing the sorbent/solvent mixture in selected areas on said substrate.

4. The process according to claim 1 wherein:

said sorbent agent is selected from the group consisting of a silica or a silicate.

5. The process according to claim 4 wherein;

said coating composition contains 0.5 to 15% by weight of silica.

6. The process according to claim 1 wherein:

said solvent used in said mixture exhibits a very high vapor pressure at the temperature of formation of the coating film.

7. The process of claim 1 wherein:

said coating composition contains 15 to 35% by weight of solvent.

8. The process according to claim 1 wherein:

said thermal treatment is at a temperature of about 110° to about 160° C., having a duration of about 1 minute to about 2 minutes 30 seconds whereby a film is formed.

9. The process of claim 1 wherein:

said solid sorbent agent is a mineral sorbent agent.

10. The process according to claim 1 wherein:

said substrate includes at least one imprint thereon prior to deposition of said plastisol coating.

11. The process according to claim 2 wherein:

said substrate includes at least one imprint thereon prior to deposition of said plastisol coating.

12. The process of claim 1 wherein:

said thermal treatment is at a temperature of between about 180° to about 210° C. whereby the plastisol coating undergoes drying.

13. The process of claim 1 including:

thermally treating the formed cracks to increase the opening of the cracks thereby defining a second thermal treatment.

14. The process according to claim 13 wherein:

said second thermal treatment is done at a temperature of about 200° with a duration of about 1 minute to 2 minutes 30 seconds.

15. The process according to claim 1 wherein said thermal treatment step produces cracks in said deposited coating and including the step of:

applying at least one coating to fill said cracks in said deposited coating.

16. The process according to claim 1 including:

carrying out a final firing operation at a temperature of about 190° C. for a period of about 1 minute to 2 minutes 30 seconds.

17. The process according to claim 15 wherein said coating used to fill said cracks is selected from a coating consisting of:

conductive carbon black, a foamable paste, an imprint or a final wear layer.

18. The process of claim 15 wherein:

said coating to fill in said cracks is applied by means of a scraper.

19. The process of claim 4 wherein:

said silica or silicate have a specific surface according to BET within the range of between about 250 and 700 $M^2/g$.

20. A surface covering exhibiting a cracked appearance made from the process of claim 1.

21. A process for the production of surface coverings exhibiting a cracked appearance including the steps of:

depositing a plastisol coating composition on a substrate, said coating composition containing a dispersion in water of effective amounts of a dry mixture of PVC and plasticizer, the plasticizer containing at least one resin forming a gel in water; and thermally treating said deposited coating, said thermal treatment being carried out at a sufficient temperature whereby an irreversible process of preliminary gelling of the coating and shinkage of the gel by evaporation of the water simultaneously occurs.

22. The process according to claim 21 wherein:

said substrate includes at least one deposit of synthetic material thereon prior to deposition of said plastisol coating.

23. The process according to claim 21 including:

depositing said plastisol coating composition containing the dispersion in water of dry PVC and of a resin forming a gel in water in selected areas on said substrate.

24. The process according to claim 21 wherein:

said thermal treatment is at a temperature of about 110° to about 160° C., having a duration of about 1 minute to about 2 minutes 30 seconds whereby a film is formed.

25. The process according to claim 1 wherein:

said at least one resin forming a gel in the presence of water is a cellulose resin.

26. The process according to claim 21 wherein:

said dispersion contains a solvating agent.

27. The process according to claim 21 including:

stabilizing the aqueous dispersion by a mixture of surfactant and antifoam agents.

28. The process of claim 21 wherein:

said thermal treatment is at a temperature of between about 180° to about 210° C. whereby the plastisol coating undergoes drying.

29. The process of claim 21 including:

thermally treating the formed cracks to increase the opening of the cracks thereby defining a second thermal treatment.

30. The process according to claim 29 wherein:

said second thermal treatment is done at a temperature of about 200° C. with a duration of about 1 minute to 2 minutes 30 seconds.

31. The process according to claim 21 wherein said thermal treatment step produces cracks in said deposited coating and including the step of:

applying at least one coating to fill said cracks in said deposited coating.

32. The process according to claim 21 including:

carrying out a final firing operation at a temperature of about 190° C. for a period of about 1 minute to 2 minutes 30 seconds.

33. The process according to claim 21 wherein:

said substrate includes at least one imprint thereon prior to deposition of said plastisol coating.

34. The process according to claim 31 wherein said coating used to fill said cracks is selected from a coating consisting of:

conductive carbon black, foamable paste, an imprint or a final wear layer.

35. The process of claim 31 wherein:

said coating to fill in said cracks is applied by means of a scraper.

36. A surface covering exhibiting a cracked appearance made from the process of claim 21.

* * * * *